US005183018A

United States Patent [19]

Vittorio et al.

[11] Patent Number: 5,183,018

[45] Date of Patent: Feb. 2, 1993

[54] MASTER CYLINDER WITH TWO-PIECE MASTER PISTON

[75] Inventors: David A. Vittorio, Columbus; Steven W. Reedy, Nashville, both of Ind.

[73] Assignee: Cummins Engine Co., Inc., Columbus, Ind.

[21] Appl. No.: 856,579

[22] Filed: Mar. 24, 1992

[51] Int. Cl.[5] ..... F02D 13/04

[52] U.S. Cl. ..... 123/321; 123/90.16

[58] Field of Search ..... 123/90.16, 321, 322

[56] References Cited

U.S. PATENT DOCUMENTS

| | | | |
|---|---|---|---|
| 4,248,045 | 2/1981 | Turner | 60/537 |
| 4,496,033 | 1/1985 | Hall et al. | 188/347 |
| 4,648,365 | 3/1987 | Bostelman | 123/321 |
| 4,706,625 | 11/1987 | Meistrick et al. | 123/321 |
| 4,711,210 | 12/1987 | Reichenbach | 123/321 |
| 5,000,145 | 3/1991 | Quenneville | 123/321 |
| 5,105,782 | 4/1992 | Meneely | 123/321 |

*Primary Examiner*—Tony M. Argenbright

*Attorney, Agent, or Firm*—Woodard, Emhardt, Naughton, Moriarty & McNett

[57] ABSTRACT

An improved master cylinder for use with an engine compression braking system includes a two-piece telescoping piston which traps a column of fluid therewithin to establish a solid column or piston for a limited length of travel of the piston. Upon achieving a particular predetermined displacement, the fluid column trapped within the two-piece piston is released, thus rapid piston movement is achieved without overtravel which may open exhaust valves of the engine to a distance wherein interference with the piston occurs. The two-piece telescoping piston is actuated in accordance with an injector pushtube or other combinations such as exhaust or intake valve cam/pushtubes.

19 Claims, 3 Drawing Sheets

MASTER CYLINDER WITH TWO-PIECE MASTER PISTON

Field of the Invention

This invention relates to engine retarders of the compression release type. More particularly, the present invention relates to a mechanism which provides rapid and limited excursion opening of the exhaust valves of an internal combustion engine in accordance with the mechanical injector lobe of a cam in a Diesel engine to avoid interfering with piston top dead center.

BACKGROUND OF THE INVENTION

Engine retarders of the compression release type, also known as engine compression braking systems, are well known in the art. Such systems are designed to convert, temporarily, an internal combustion engine into an air compressor so that a retarding horsepower or braking action is established in the vehicle drive train. The basic design for an engine retarding system of the type referred to is disclosed in U.S. Pat. No. 3,220,392 assigned to Cummins Engine Company of Columbus Ind. In that design, a hydraulic system is employed wherein the motion of a master piston actuated by an appropriate intake, exhaust or fuel injector pushtube or rocker arm controls the motion of a slave piston which opens the exhaust valve of the internal combustion engine near the end of the compression stroke, whereby the work done in compressing the intake air is not recovered during the expansion or "power" stroke, but, instead, is dissipated through the exhaust and cooling systems of the engine.

In most Diesel engines, a mechanical fuel injector for each cylinder is driven from a third cam lobe of the engine cam shaft. It is therefore desirable to derive the motion for the compression release retarder from the fuel injector pushtube for the cylinder experiencing the compression release event. The fuel injector pushtube is a desirable source of motion both because it peaks very shortly after top dead center (TDC) position of the piston following the compression stroke and also because the effective stroke of the injector pushtube is completed in a relatively short period, e.g. 20–40 crank angle degrees.

The need for a compression brake master cylinder which opens the exhaust valves in a rapid fashion is discussed in U.S. Pat. No. 4,706,624 to Meistrick et al. The process and apparatus disclosed therein are directed towards cyclically storing energy in a plenum, releasing the stored energy from the plenum at a predetermined point in the travel of a master piston driven by an exhaust or fuel injector pushtube and directing the stored energy to a slave piston whereby the exhaust valve is opened rapidly at a predetermined time. Such an approach is referred to as indirect actuation or displacement of the exhaust valves since a hydraulic device stores and releases energy to move the valves.

Quenneville, U.S. Pat. No. 5,000,145, discloses a compression release retarding system wherein a master cylinder assembly includes a master piston of variable length. The variable length master piston travels a fixed distance to the pressure release point so that the timing of the compression release is precisely controlled and independent of installation and engine component tolerances. Rather than a direct displacement of a slave piston for a cylinder with a master piston, Quenneville teaches indirectly displacing the slave piston by a master piston which supplies high pressure hydraulic fluid to an accumulator and triggers release of the accumulated hydraulic fluid to the slave piston at an appropriate time as in the Meistrick et al. '624 patent.

A more simplistic master cylinder with a variable length telescoping piston which directly actuates a slave piston to open the exhaust valves in an internal combustion engine would enhance the operation of an engine compression braking system as well as provide a simplified approach to rapid actuation or opening of the exhaust valves of a particular cylinder in conjunction with limited excursion or displacement of the valves.

SUMMARY OF THE INVENTION

An improved master cylinder according to one aspect of the present invention for use in conjunction with an engine compression braking system having an hydraulically activated slave cylinder includes a cylinder means having a bore therein and wherein the bore is in fluid communication with the slave cylinder. A telescoping piston means is inserted into the bore for providing a force to a fluid within the bore, the telescoping piston means including a piston fluid port in fluid communication with an internal chamber of the piston means, and wherein pressurized fluid supplied to the internal chamber extends the telescoping piston to a predetermined elongated length. The master cylinder also includes means for supplying a pressurized fluid to the piston fluid port when the telescoping piston is in a first position thereby expanding the telescoping piston to the predetermined elongated length, a means for releasing fluid from the internal chamber when the telescoping piston means is moved into said bore a predetermined distance, and an actuator means contacting the telescoping piston means for displacing the telescoping piston means into the bore in response to the occurrence of a predetermined cyclical event in the operation of the engine.

One object of the present invention is to provide an improved master cylinder for use in an engine compression braking system.

Another object of the present invention is to provide an improved master cylinder having a telescoping master piston of two-piece construction to enable rapid opening of the exhaust valves of an engine yet avoiding excess exhaust valve displacement to avoid interference between the exhaust valves and a piston approaching top dead center.

Yet another object of the present invention is to provide a more economically manufacturable master cylinder having improved performance characteristics.

Still another object of the present invention is to provide an improved master cylinder for a compression braking system wherein a reduced quantity of parts is required to achieve a modified valve motion in view of predetermined cam profile used to actuate the master cylinder when needed for engine braking and to actuate a fuel injection device for normal engine operation.

These and other objects of the present invention will become more apparent from the following description of the preferred embodiments.

DESCRIPTION OF THE PREFERRED EMBODIMENT

Figure 1:
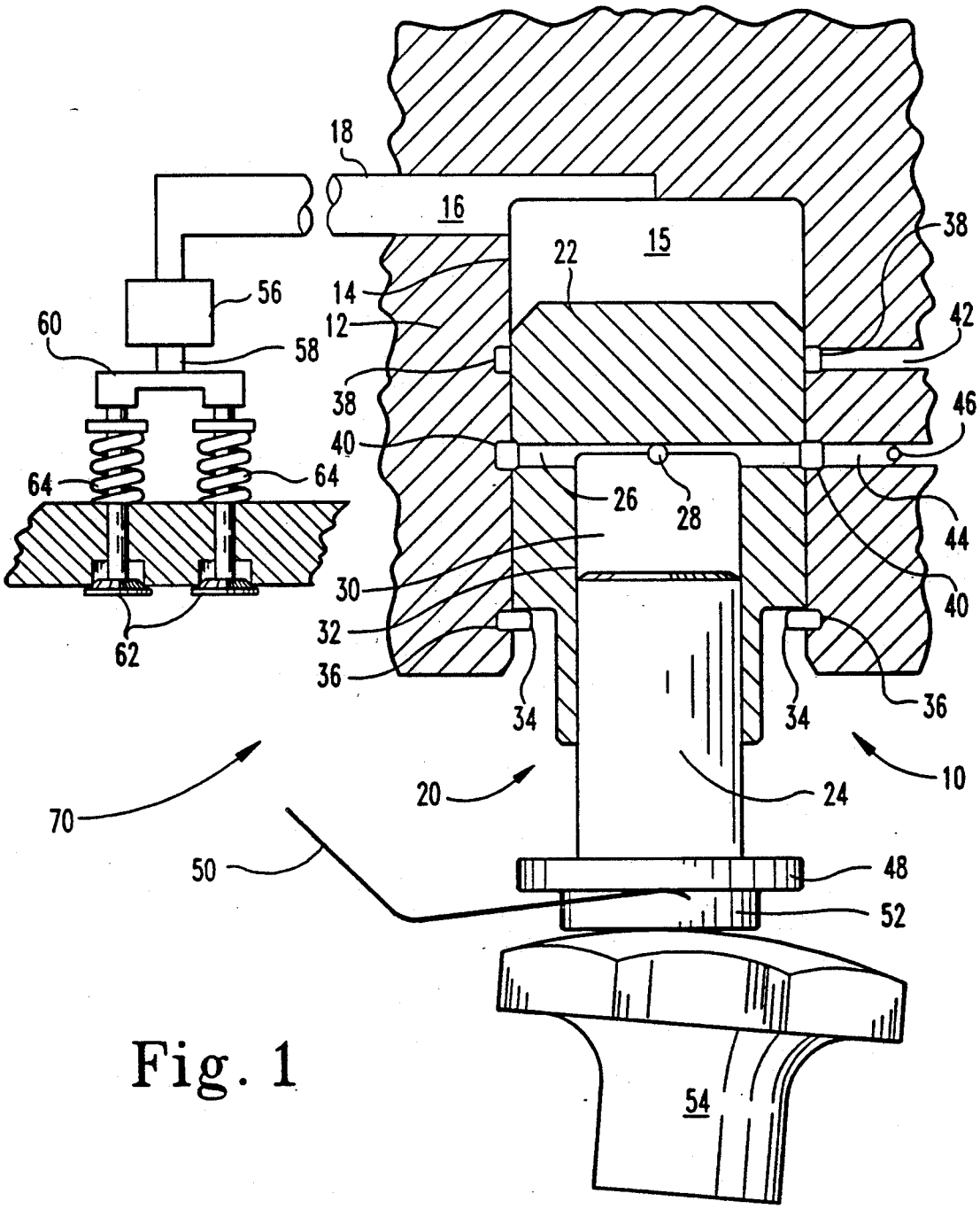
FIG. 1 is a cross-section of the improved master cylinder according to the present invention and which diagrammatically illustrates the hydraulic coupling between the master cylinder and a slave cylinder mechanically coupled to the exhaust valves of an engine.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an improved master cylinder 10 according to one aspect of the present invention is shown. Master cylinder 10 includes an engine brake housing 12 having a cylindrical bore 14 machined therein. Bore 14 defines a cavity 15 that is in fluid communication with fluid passage 16 and fluid conduit 18. A typical hydraulic fitting (not shown) well known in the art joins passage 16 with conduit 18. Master cylinder 10 also includes a telescoping two-piece piston 20 comprised of a master piston 22 and a piston plunger 24. Master piston 22 includes an annular groove 26 and a cross drilling 28 to create a fluid flow path between annular groove 26 and cavity 30 defined by a cylindrical bore 32 in master piston 22. Snap ring 34 is installed in an annular groove 36 machined into the inner surface of bore 14. Annular grooves 38 and 40 are also machined into the inner surface of bore 14. Groove 38 is in fluid communication with a fluid outlet passage or port 42. Groove 40 is in fluid communication with a fluid inlet passage or port 44. Located within fluid inlet passage 44 is a one-way fluid flow check valve 46 which allows fluid to flow into annular groove 40 and prevents flow out through passage 44. Piston plunger 24 includes a flange 48 engaged by a leaf spring 50. Piston plunger 24 also includes a wear pad 52 that engages rocker lever adjusting screw 54. Fluid conduit 18 supplies pressurized fluid to slave cylinder 56 wherein slave piston 58 responds by displacing exhaust valve cross-head 60 to open exhaust valves 62. Springs 64 urge exhaust valves 62 into a closed position when the fluid pressure in conduit 18 falls below that pressure required to compress springs 64 via slave piston 58. Springs 64 urge piston 22 toward plunger 24 and screw 54 when screw 54 is at innerbase circle of the cam lobe (not shown).

Operationally speaking, the improved master cylinder 10 functions as follows. Screw 54 is displaced upward towards plunger 24 in accordance with movement of a fuel injector pushtube or an exhaust valve pushtube (not shown) of an internal combustion engine (not shown). On inner base circle of the injector or exhaust valve cam lobe (position of screw 54 shown in FIG. 1), pressurized oil in the cavity 15 above the master piston 22 holds the master piston against snap ring 34 at the bottom of the master piston bore 14. In that position, annular groove 26 aligns with fluid inlet passage 44 of housing 12. Pressurized engine oil flows past check valve 46 through inlet passage 44 into the annular groove 26 and through cross-drilling 28 into the cavity 30. As cavity 30 fills with pressurized fluid, piston plunger 24 is forced downward so that wear pad 52 contacts screw 54. Leaf spring 50 rests on flange 48 at the bottom of the piston plunger 24 retaining the telescoping two-piece piston in the bore 14 when the engine compression braking system is off or inactive. As the pushtube (not shown) begins its upward motion, the rocker lever adjusting screw 54, mechanically actuated by the pushtube, pushes upward against the piston plunger 24 creating a pressure differential across check valve 46 and a trapped volume of oil in the cavity 30 inside the master piston 22. The two-piece piston 20 moves upward displacing oil in cavity 15 through a fluid passage 16 in the locked hydraulic circuit, comprised of fluid conduit 18, slave cylinder 56 and passage 16, connected to the slave piston 58. The slave piston 58 opens the exhaust valves 62 at or about the end of the compression stroke of the particular cylinder in which the exhaust valves are located. At a designated vertical pushtube displacement, the two-piece piston 20 displacement discontinues as the annular groove 26 in the master piston 22 aligns with fluid outlet passage 42 in the housing 12. Passage 42 vents to the engine overhead. Trapped oil in the cavity 30 inside the master piston 22 is evacuated through the cross-drilling 28 and through the fluid outlet passage 42 as the rocker lever adjusting screw 54 displaces the piston plunger 24 upward inside of the master piston 22 until the pushtube reaches outerbase circle of the cam lobe (not shown). When movement of the master piston 22 ceases, further opening of the exhaust valves 62 also ceases. After the pushtube retracts from outerbase circle, the two-piece piston assembly 20 moves downward causing the slave piston 58 to retract until the master piston 22 contacts the snap ring 34. Subsequently, valve 46 opens allowing oil to flow into the cavity 30 above the piston plunger 24 thereby maintaining contact between the head of the rocker lever adjusting screw 54 and plunger 24 as screw 54 moves back to the innerbase circle position of the cam lobe (not shown).

Preferred materials for the wear pad are ceramic or tool steel. The master piston and piston plunger may be constructed of ceramic, tool steel, high carbon content steel alloys, or using powdered metal technology. Housing 12 is typically constructed using cast iron technology.

Figure 2:
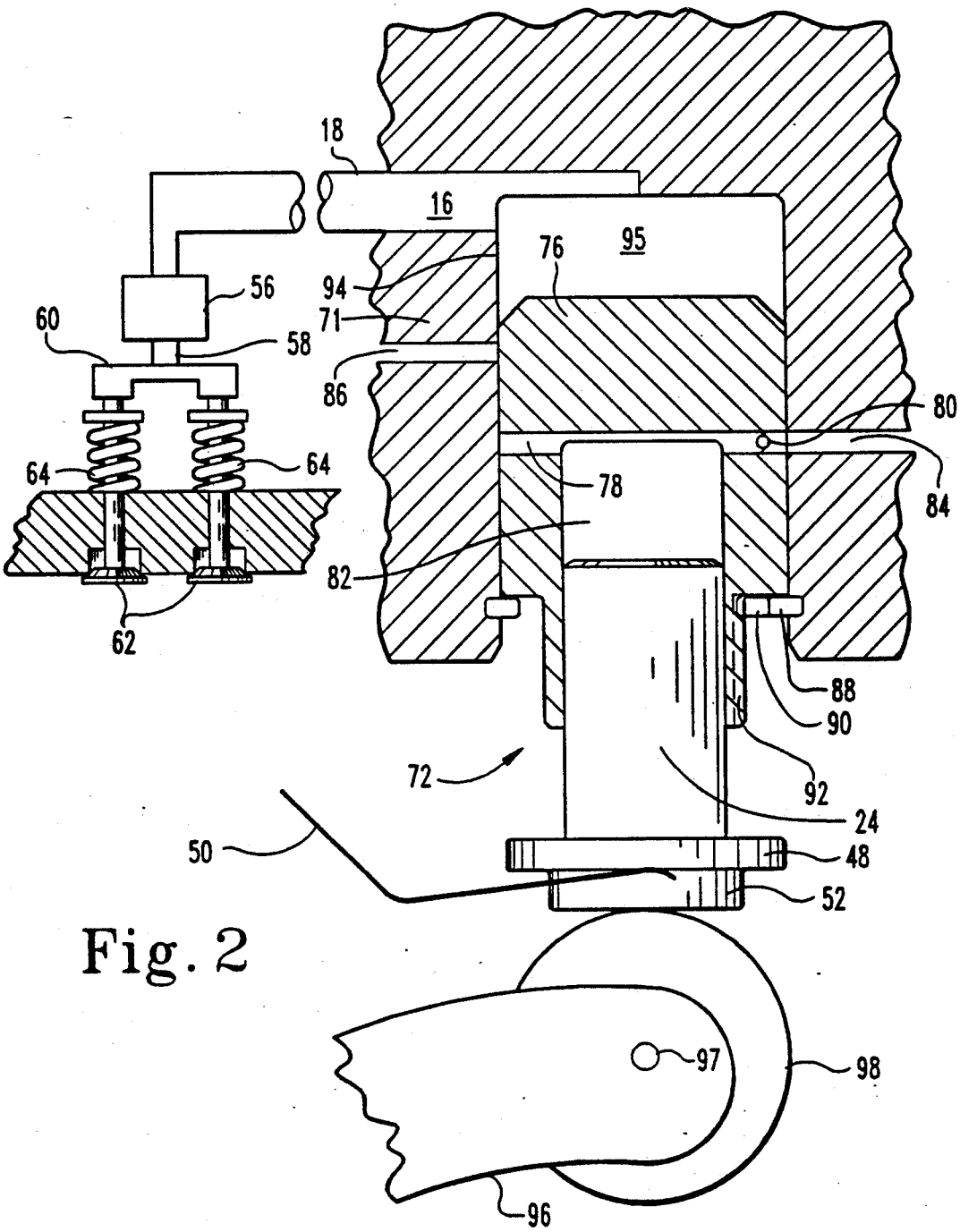
FIG. 2 is a cross-section of another master cylinder according to the present invention.
Figure 3:
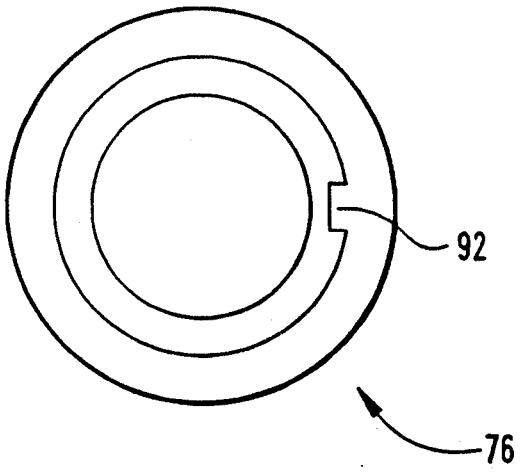
FIG. 3 is an end view of one portion of the master piston shown in FIG. 2.

Referring now to FIG. 2, an alternate embodiment of the improved master cylinder 70 according to the present invention is shown. Components and details in FIG. 2 which are identical in function and form with components and details shown in FIG. 1 have the same reference numerals. In this embodiment, two-piece telescoping piston 72 is comprised of piston plunger 24 and master piston 76. Master piston 76 includes a cross-drilled through hole 78 machined into master piston 76. Check valve 80 is installed in the cross-drilled through hole 78 to enable fluid communication between cavity 82 and fluid inlet passage or port 84. Fluid outlet passage 86 and fluid inlet passage or port 84 are machined, cast or drilled into housing 71 and provide identical functions with respect to the fluid outlet passage 42 and fluid inlet passage 44 of the embodiment shown in FIG. 1. Spring 50 contacts flange 52 and urges plunger 24 upward into piston 76. The operation of the improved master cylinder 70 is substantially identical with the operation of the improved master cylinder 10 shown in FIG. 1, with the subtle differences residing in the following. Snap ring 88 includes a tang 90 about which a slot or groove 92 of master piston 76 is positioned. The groove 92 is shown in more detail in FIG. 3. Alignment of tang 90 in groove 92 prevents rotation of master piston 76 in bore 94 of housing 71. Piston plunger 24 is displaced upward in response to cam/pushtube forces applied to arm 96 thereby urging roller 98 upwards in contact with wear pad 52. Roller 98 rotates or pivots about pin 97 to provide rolling contact with wear pad 52. The fluid inlet passage 84 and fluid outlet passage 86 reside on opposite sides of the master piston bore 94. As in the embodiment of FIG. 1, passage 16 is joined with fluid conduit 18 by a well known fitting (not shown).

In a first predetermined position (as shown in FIG. 2) port 84 aligns with one end of through hole 78 and fluid from port 84 flows past valve 80 and enters cavity or internal chamber 82. Plunger 24 is thus forced out of cavity 82. Hydraulic fluid trapped in cavity 82 transforms pistons 76 and 24 into a solid, extended telescoping piston means until displaced by the actuator means bore 94 and hole 78 aligns with port 86. Thereafter fluid in cavity 82 is expelled through port 86. Springs 64, valves 62, cross-head 60, slave piston 58 and slave cylinder 56 are identical with the similarly numbered components shown in FIG. 1 and no further discussion of their functionality should be required at this juncture.

During operation, oil flows through only one side of the cross-drilling (near the fixed location of check valve 80) when cavity 82 is being filled with pressurized fluid. As the roller 98 is moved upward in response to cam lobe (not shown) actuation, the check valve 80 will close sealing cavity 82. The entire two-piece piston 72 assembly then moves upward in bore 94 as a solid column forcing hydraulic flow from cavity 95 into conduit 18 until the opposite side of the cross-drilling 78 aligns with the fluid outlet passage 86. Oil will then flow out of cavity 82 through the fluid outlet passage 86 as the piston plunger 24 is displaced upward within master piston 76. In all other aspects, the improved master cylinder 70 functions identically with the master cylinder 10 of FIG. 1 to actuate exhaust valves as shown in FIG. 1 via a slave cylinder/piston assembly.

Figure 4:
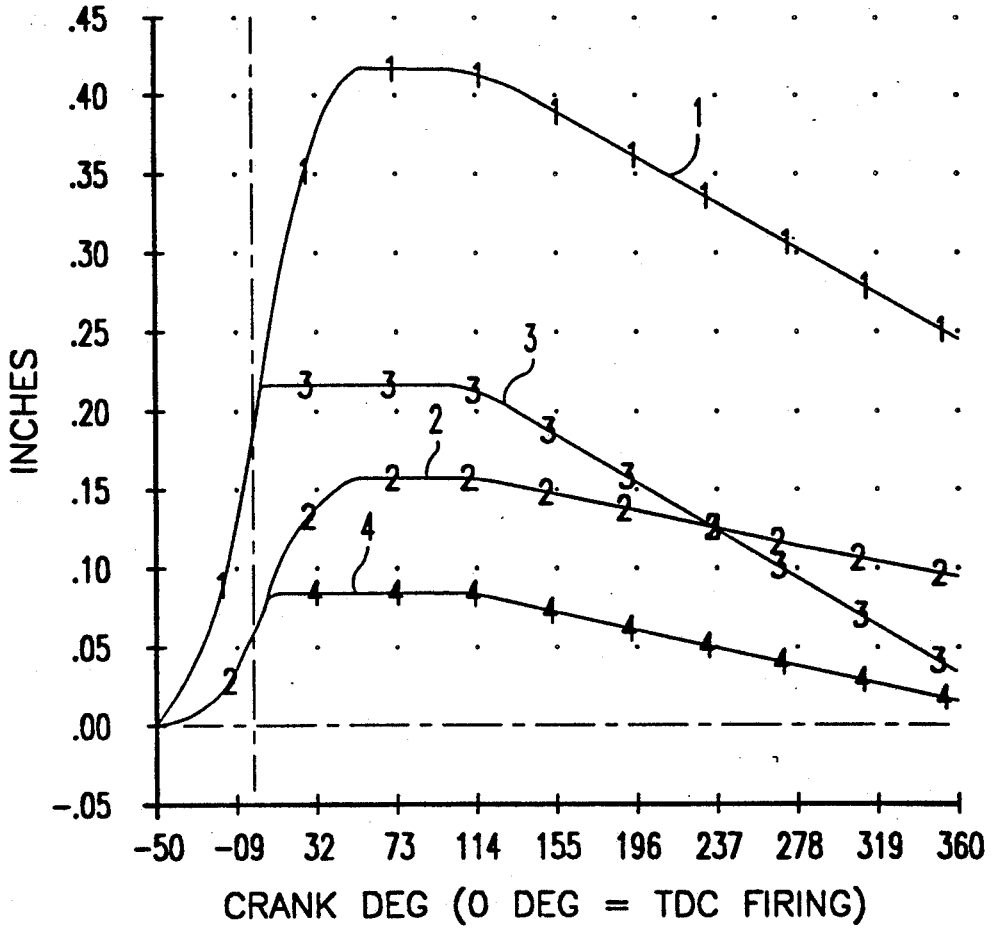
FIG. 4 is a graph including four theoretical curves representing master piston and slave piston displacements with and without a two-piece master piston according to the present invention.

Referring now to FIG. 4, a graph is illustrated which plots displacement versus crank angle degrees for theoretical displacements of a master piston and slave piston, with and without a two-piece master piston. Curves 1 and 2 are plots of master piston and slave piston displacement without a two-piece master cylinder, respectively. Curves 3 and 4 are master piston and slave piston displacement with a two-piece master cylinder, respectively. Note that the slave piston displacement in curve 2 is greater at top dead center overlap than at top dead center firing, which may lead to insufficient valve to piston clearance at this moment. Slave piston displacement with the two-piece master piston (curve 4) is less at top dead center overlap than at top dead center firing which enables increased valve lift at top dead center firing to improve retarding operation of an engine compression braking system.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A master cylinder for use in conjunction with an engine compression braking system having an hydraulically activated slave cylinder, said master cylinder comprising:

cylinder means having a bore therein and wherein said bore is in fluid communication with said slave cylinder;

telescoping piston means inserted into said bore for providing a force to a fluid within said bore, said telescoping piston means including a piston fluid port in fluid communication with an internal chamber of said piston means, wherein pressurized fluid supplied to said internal chamber extends said telescoping piston to a predetermined elongated length;

means for supplying pressurized fluid to said piston fluid port when said telescoping piston is in a first position thereby expanding said telescoping piston to said predetermined elongated length;

means for releasing fluid from said internal chamber when said telescoping piston means is moved into said bore a predetermined distance; and actuator means contacting said telescoping piston means for displacing said telescoping piston means into said bore in response to the occurrence of a predetermined cyclical event in the operation of the engine.

2. The device of claim 1 wherein said bore contains hydraulic fluid at a pressure above atmospheric pressure for establishing a hydraulic link between said telescoping piston means and said slave cylinder, and wherein said hydraulic fluid displaces said telescoping piston means out of said bore to an initial predetermined position in contact with said actuator means.

3. The device of claim 2 wherein said telescoping piston means includes a first piston having a cylindrical cavity substantially axially aligned with said bore, said first piston sized to correspond with and inserted into said bore, said telescoping piston means also including a second piston sized to correspond with and inserted into said cylindrical cavity wherein said second piston and said cylindrical cavity of said first piston define said internal chamber, said first piston also having a piston fluid port communicating with said internal chamber.

4. The device of claim 3 wherein said actuator means is displaced substantially simultaneously in time with the occurrence of an injection period of a cylinder of the engine.

5. The device of claim 4 wherein said means for supplying pressurized fluid includes a source of pressurized fluid supplying pressurized fluid to a first fluid port in said cylinder means that establishes fluid communication with a first location in said bore, wherein said means for releasing fluid is a second fluid port in said cylinder means that establishes fluid communication with a second location in said bore, and wherein said first piston includes a check valve means situated in said piston fluid port for allowing fluid flow from said first fluid port through said first piston into said internal chamber when said first piston is at a first predetermined axial location in said bore, said first piston also including a pressure release fluid port for enabling fluid flow out from said internal chamber through said second fluid port when said first piston is at a second predetermined axial location in said bore.

6. The device of claim 5 including a spring means and wherein said second piston includes a flange engaged by said spring means thereby urging said second piston into said bore of said first piston.

7. The device of claim 4 wherein said means for supplying pressurized fluid includes a source of pressurized fluid supplying pressurized fluid to a first fluid port in said cylinder means that establishes fluid communication with a first location in said bore, wherein said means for releasing fluid is a second fluid port in said cylinder means that establishes fluid communication with a second location in said bore, and wherein said first fluid port includes a check valve means situated in said first fluid port for allowing fluid flow through said first fluid port and through said first piston into said internal chamber when said first piston is at a first predetermined axial location in said bore, said first piston also including a pressure release fluid port for enabling fluid flow out from said internal chamber through said second fluid port when said first piston is at a second predetermined axial location in said bore.

8. The device of claim 7 including a spring means and wherein said second piston includes a flange engaged by said spring means thereby urging said second piston into said bore of said first piston, and wherein said first piston includes a piston groove axially aligned with said bore, said master cylinder also including means engaging said piston groove for preventing rotation of said first piston within said bore.

9. The device of claim 4 including means for retaining said first piston within said bore.

10. The device of claim 9 wherein said first piston includes a piston groove axially aligned with said bore, said master cylinder also including means engaging said piston groove for preventing rotation of said first piston within said bore.

11. A master cylinder for use in conjunction with slave cylinder actuator of an engine compression braking system, said master cylinder comprising:

a housing having a bore therein;

telescoping piston means inserted in said bore for producing hydraulic pressure in said first fluid port, said telescoping piston means including a first piston sized to be received in said bore, said first piston having a cylindrical cavity and a piston fluid port communicating with said cylindrical cavity, said telescoping piston means also including a second piston received into said cylindrical cavity;

means for supplying pressurized fluid to said piston fluid port when said first piston is axially positioned at a first predetermined location;

means for releasing pressure from said piston fluid port when said first piston is axially positioned at a second predetermined location;

actuator means contacting said second piston for displacing said second piston toward said first piston in response to the occurrence of a predetermined cyclical event in the operation of the engine.

12. The device of claim 11 wherein said piston fluid port is a cross-drilled through hole and wherein said housing includes an output fluid port communicating with the innermost portion of said bore, a first fluid port communicating with a first location axially displaced from the innermost portion of said bore, and a second fluid port communicating with a second location axially displaced from said innermost portion of said bore.

13. The device of claim 12 wherein said check valve is located in said hole and wherein said hole aligns with said first fluid port when said first piston is at said first predetermined position, said check valve positioned so that fluid from said first fluid port passes through said valve before entering said cylindrical cavity, and wherein said hole aligns with said second fluid port when said first piston is at said second predetermined position, and wherein hydraulic fluid is contained in said bore by said telescoping piston means to provide a hydraulic link between said telescoping piston means and said slave cylinder actuator through said output fluid port.

14. The device of claim 11 wherein said first piston includes an annular ring in communication with said piston fluid port and wherein said housing includes an output fluid port communicating with the innermost portion of said bore, a first fluid port communicating with a first location axially displaced from the innermost portion of said bore, and a second fluid port communicating with a second location axially displaced from said innermost portion of said bore, and wherein said annular ring aligns with said first fluid port with said piston in said first predetermined position and said annular ring aligns with said second fluid port when said first piston is displaced into said second predetermined position.

15. The device of claim 14 including a check valve located in said first fluid port to enable fluid flow only into said bore.

16. The device of claim 15 including means for retaining said first piston in said bore and spring means for urging said second piston into said cylindrical cavity.

17. The device of claim 16 wherein said means for retaining is a snap ring received into a groove in said bore.

18. The device of claim 15 wherein said second piston includes a wear pad means attached to said piston for minimizing wear resulting from contact between said second piston and said actuator means.

19. An improved master cylinder device for use in actuating a slave cylinder assembly, said slave cylinder assembly including a slave fluid port, a spring loaded slave piston and a slave cylinder and wherein pressurized fluid supplied to the slave fluid port moves said slave piston to engage and open the exhaust valves of an internal combustion engine, said master cylinder comprising:

a housing having a cylindrical cavity having a central axis, a first fluid port in fluid communication with the innermost portion of said cylindrical cavity, a second fluid port in fluid communication with a first location on the lateral surface of said cylindrical cavity, and a third fluid port in fluid communication with a second location on the lateral surface of said cylindrical cavity;

a first piston having a first base and a second base, said first piston sized to conform with and inserted into said cylindrical cavity and movable freely there within, said first piston also including an annular groove, said second base having a void therein defining a cylindrical opening, wherein the central axis of said cylindrical opening is substantially parallel with the central axis of said cylindrical cavity, said first piston also including a fluid passage establishing fluid communication between said annular groove and said cylindrical opening;

a second piston sized to conform with and inserted into said cylindrical opening and movable freely therewithin;

a source of pressurized fluid supplied to said third fluid port, said source of pressurized fluid including a means for preventing backflow into said source of pressurized fluid;

actuator means for engaging said second piston and forcing said second piston into said cylindrical opening in response to a predetermined engine event;

spring means engaging said second piston for urging said second piston out of said cylindrical opening to contact said actuator means; and movement limiting means engaging said first piston for establishing a mechanical limit position, said first piston contacting said movement limiting means when hydraulic pressure from said slave fluid port urges said first piston out of said cylindrical cavity, said movement limiting means located so that said annular groove aligns with said third fluid port when said first piston contacts said movement limiting means.

* * * * *